United States Patent [19]

Dolizy

[11] Patent Number: 4,698,496

[45] Date of Patent: Oct. 6, 1987

[54] IMAGE DISSECTOR TUBE WITH LIGHT FILTER

[75] Inventor: Pierre Dolizy, Ris-Orangis, France

[73] Assignee: U.S. Philips Corporation, New York, N.Y.

[21] Appl. No.: 783,899

[22] Filed: Oct. 3, 1985

[30] Foreign Application Priority Data

Oct. 30, 1984 [FR] France ..... 84 16554

[51] Int. Cl.[4] ..... H01J 31/28; H01J 40/16

[52] U.S. Cl. ..... 250/213 VT; 313/524

[58] Field of Search ..... 250/213 VT, 226; 313/523, 524, 544; 350/311, 317

[56] References Cited

U.S. PATENT DOCUMENTS

| | | | |
|---|---|---|---|
| 2,821,637 | 1/1958 | Roberts et al. | 250/213 VT |
| 3,575,628 | 4/1971 | Word | 250/213 VT X |
| 3,663,913 | 5/1972 | Shaw | 250/226 X |
| 3,748,523 | 7/1973 | Beyer et al. | 250/213 VT X |
| 3,863,093 | 1/1975 | Orthuber | 250/213 VT X |
| 4,004,176 | 1/1977 | Otake et al. | 350/317 X |
| 4,376,889 | 3/1983 | Swift | 250/213 VT |
| 4,536,679 | 8/1985 | Guittard et al. | 313/544 X |

*Primary Examiner*—Eugene R. LaRoche
*Assistant Examiner*—David Mis
*Attorney, Agent, or Firm*—F. Brice Faller

[57] ABSTRACT

Photoelectric detection device comprising a vacuum chamber provided with a window having a substrate which bears a photocathode on the internal surface of the vacuum chamber is sensitive to incident light radiation between a short wavelength $\lambda_1$ bottom threshold and a longer wavelength $\lambda_2$ upper threshold. Electrons emitted by the photocathode are focused, accelerated and deflected by electronic means to deliver signals or an image representative of luminous events projected onto the photocathode. Window is provided with at least one light filter which determines the wavelength range for which the detection device is operational, eliminating wavelengths greater than a wavelength $\lambda_f$ such that $\lambda_1<\lambda_f<\lambda_2$. This light filter can be a pass-band filter which also eliminates wavelengths lower than a wavelength $\lambda'_f$ such that $\lambda_1<\lambda'_f<\lambda_f$. This filter is preferably an interference filter, arranged on the outside and/or the inside of the vacuum chamber, constituted by a series of thin layers applied to the substrate. The invention has its principal application in image dissector tubes.

20 Claims, 3 Drawing Figures

IMAGE DISSECTOR TUBE WITH LIGHT FILTER

BACKGROUND OF THE INVENTION

The invention relates to a photoelectric detection device comprising a vacuum chamber provided with a window having a substrate which bears a photocathode on the internal surface of the vacuum chamber. The device is sensitive to incident luminous radiation between a short wavelength bottom threshold $\lambda_1$ and a longer wavelength upper threshold $\lambda_2$, with the electrons emitted by the photocathode being focused, accelerated and deflected by electronic means to deliver signals or an image representative of luminous events projected onto the photocathode.

The invention also relates to tubes using this type of photoelectric detection device such as image dissector tubes, and in a general manner all image reproduction tubes for which localised errors in reproduction are to be eliminated.

This aspect of localised errors is of considerable importance in image dissector tubes. These tubes are generally designed to detect punctiform events appearing in a field of vision, principally a scanning of the sky, such as in the observation of clouds or particles in meteorology or in the tracking of stars in astronomy. The image detected by such a tube thus appears in the form of a fairly uniform image in which the events to be detected appear in very small dimension in relation to the total extent of the image. In this image, however, there are also faults which can be mingled with the events to be detected or hinder their detection and which thus detract from the efficiency of the dissector tube.

A dissector tube generally comprises a vacuum chamber provided with a window having a photocathode which emits electrons on the incidence of luminous radiation. The scene to be analysed is projected optically onto the inlet window. The electrons emitted by the photocathode are accelerated, focused and deflected by suitable electron optics onto an electron multiplier having a very small aperture at its entrance. By a system of electronic scanning, the electrons emitted by each point of the image formed on the photocathode penetrate the multiplier which reproduces an electrical signal by conventional electronic means, which can be displayed on a screen or utilised to position the dissector tube.

When the image bears the faults previously mentioned, these may result in a faulty perception of the image or difficulties in positioning the dissector tube, as the fault may take the place of the event in question in the image field, and thus control the enslavement of the dissector tube.

Such a dissector tube is described in the publication entitled: "The Image Dissector as an Optical Tracker" by E. H. Eberhardt published in the "Proceedings of the seminar on optical tracking systems, El Paso, Tex., U.S.A., Jan. 18–19th, 1971.

A dissector tube is described therein which is used for the tracking of stars. In the image field obtained on the photocathode the star appears in the form of a luminous point. For these applications, it may be necessary to detect variations in position on the scale of one micron on the photocathode. It happens very often that faults can be confused with the luminous event to be detected and followed. These tend to be caused by sudden variations in sensitivity, at a short distance, between an image point and a neighbouring image point, creating the most disastrous distortion.

SUMMARY OF THE INVENTION

According to the invention, the window is provided with at least one light filter which determines the wavelength range for which the detection device is operational, eliminating wavelengths of greater than $\lambda_f$, such that $\lambda_1<\lambda_f<\lambda_2$. This light filter may be a pass band filter which also eliminates wavelengths lower than a wavelength $\lambda'_f$, such that $\lambda_1<\lambda'_f<\lambda_f$.

In the image structures detected by a dissector tube it appeared that these faults were due for the most part to a disruption of the functioning of the photocathode, in the form of variations in its quantum efficiency. These faults are usually punctiform faults of approximately 10 $\mu m \times 10$ $\mu m$ or oblong faults of approximately 10 $\mu m \times 50$ $\mu m$. These faults may result in variations in quantum efficiency on the same scale as the quantum emission variations produced under the action of the events to be detected and which are in the range of 1%. It follows that it may be difficult in many cases to discern the useful signal from the disturbed signal.

The photoelectric power in transmission $Y_T$ for the incident energy photons $h\nu$ is written as follows:

$$Y_T(h\nu) = a\int_0^{e_m} P(s, h\nu) \cdot I(x, h\nu) \cdot dx$$

where $$P(x, h\nu) = P(o, h\nu) \cdot f(x, v, L(h\nu))$$

with

- $e_m$: thickness of the photocathode,
- x: depth at which the photon is absorbed,
- I(x, $h\nu$): density of energy photons $h\nu$ absorbed at the depth x,
- P(o, $h\nu$): probability of emission of electrons at the surface with energy photons $h\nu$,
- L($h\nu$): depth of escape of photoelectrons,
- v: speed of recombination of electrons at the substrate-photocathode interface.

This indicates that the photoelectric power depends on the depth at which the photons are absorbed in the photocathode, thus the quantity of material concerned, as well as the depth from which the electrons will be able to escape into the vacuum chamber.

It is clear from the observations made by the applicant that these variations in photoelectric power are connected with the composition and thickness of the layers, the probability of electron emission, the topology of the surfaces, . . . these parameters having a different effect according to the wavelength range of the incident beam.

It has been shown that the photoelectric power in blue light ($\lambda_b$=430 nm) for a photocathode of the composition ($Na_2K$ Sb, Cs) is at its maximum for a thickness of approximately 7 nm. The antimonides in thin layers have a tendency to nucleate on the substrate and to provoke local variations in thickness which may reach as much as 2 nm. Equally, the optical parameters $n_m$ and $k_m$ of the layers, which are respectively the real and complex indices of a photocathode of thickness $e_m$, are highly sensitive to variations in the thickness and composition of the layers. It follows that local variations in the photoelectric power $Y_T$ may reach values of approximately 4%. It has been shown that fluctuations in composition were closely linked to the nature of the substrate, with alkaline materials reacting with the substrate when this is of glass.

In the same way, considerable variations in the photoelectric power $Y_T$ in red light ($\lambda_r > 700$ nm) have been demonstrated between various samples. This proves to be due to a lower probability of electron emission, and to a higher emission probability gradient when the energy of the photons decreases. This results in local variations in the photoelectric power which may be as much as 4%, that is to say relative variations which can reach 100%.

In green light ($\lambda_v = 520$ nm), the variations in photoelectric power were shown to be much lower than for blue and red light. This is due to the fact that to obtain maximum photoelectric power the photocathode thickness used is in the region of 68 nm, whereby fluctuations in thickness linked to the nucleation of layers have a much weaker effect. In the same way, the electron emission probability gradient is lower around the wavelength of green light. It has been shown by experiments conducted by the applicant that the considerable variations in the photoelectric power $Y_T$, leading to the appearance of the faults previously defined at the level of the photocathode, were principally due to the association of the mechanisms which have just been described, these being active for incident light wavelengths in the vicinity of high wavelengths, verging towards the sensitivity threshold $\lambda_2$ of the photocathode.

To counteract this, the invention suppresses the influence of the sensitivity threshold $\lambda_2$ of the detection device by filtering the incident light spectrum and suppressing this high threshold $\lambda_2$. The high sensitivity threshold of the detection device after filtering is then that of the filter inserted. This filter can be an interference filter constituted by a series of layers of material with high and low optical indices, the thickness of which are determined according to the spectral band where transmission is required. The high optical index materials are for example $ZrO_2$, $CeO_2$, ZnS, $TiO_2$, $Ta_2O_5$, $WO_3$. Low optical index materials are for example $MgF_2$, $NaAlF_2$, $CaF_2$, $BaF_2$.

The creation of a filter adapted to a given type of photocathode can proceed in the following manner. A photocathode is placed on a substrate and the photoelectric power of this photocathode is determined according to the wavelength. On this sensitivity curve the wavelength $\lambda_f$ is defined (for example $\lambda_f = 760$ nm) at which this sensitivity is at approximately 10% of the maximum sensitivity. The filter is then determined to eliminate wavelengths greater than the value $\lambda_f$, thus eliminating wavelengths close to the sensitivity threshold $\lambda_2$ ($\lambda_2 > \lambda_f$). The layer of material with high and low optical index will be piled one on top of the other with thicknesses according to the type of filter required.

For this purpose, a low-pass filter (one which passes shorter wavelengths) is created which cuts off the longer wavelengths at $\lambda_f = 760$ nm for which, at wavelength $\lambda_{fA} = \lambda_f = 760$ nm, the transmission of the low-pass filter is perhaps in the region of 10%. The filter is, to offer an example, composed of a series of layers with thicknesses equal to a quarter or a half of a wavelength $\lambda_o$ (with $\lambda_o = 0.58\lambda_{FA}$), or in the specific example selected $\lambda_o = 440$ nm. The series of layers will then be of the type A:

$$\left|\frac{\lambda_o}{4}(B)\cdot\frac{\lambda_o}{2}(H)\cdot\frac{\lambda_o}{4}(B)\right|^P$$

where $\lambda_o/4$ (B) represents a thickness equal to $\lambda_o/4n$, of the material (B) with low index n, and $\lambda_o/2$ (H) represents a thickness equal to $\lambda_o/2N$ of the material (H) with high index N, the number P indicating that this structure is repeated P times.

It was also shown, however, that the lower threshold of sensitivity of the photoelectric detection device was equally responsible for the discrepancies of the photoelectric power of the photocathode. The invention also provides an additional improvement by equally suppressing the lower sensitivity threshold of the photoelectric detection device. For this purpose, a wavelength $\lambda'_f = 440$ nm is also defined, under which there is a zone in which there appear the disturbances brought about by the interactions of a chemical nature between the substrate and the photocathode. In the case of a photocathode with the composition $Na_2K$ Sb, Cs and of a thickness equal to 68 nm, its sensitivity for $\lambda'_f = 440$ nm is equal to approximately 90% of its maximum sensitivity. A high-pass filter is then defined which, with the same notations as above, can be of the type B:

$$\left|\frac{\lambda_o}{8}(H)\cdot\frac{\lambda_o}{4}(B)\cdot\frac{\lambda_o}{8}(H)\right|^P$$

with $\lambda_o = 0.84\lambda_{fB}$. The value of $\lambda_{fB} = \lambda'_f$ is that for which the transmission of the high-pass filter is for example in the region of 10%. With $\lambda_{fB} = 440$ nm, then $\lambda_0 = 370$ nm.

In order to define a useful transmission band for the filter it is possible to arrange filters of the types A and B on both sides of the substrate. It is also possible to create a filter of a type C such that:

$$\left|\frac{\lambda_o}{2}(B)\cdot\frac{\lambda_o}{4}(H)\right|^P$$

In the latter case, to determine a filter having a transmission of between 480 nm and 680 nm, the wavelength value to be taken into consideration for the series of layers will then be $\lambda_o = 570$ nm. For a photocathode with the composition $Na_2K$ Sb, Cs, the thickness of the latter must be 68 nm to have a maximum photoelectric power in the green.

In an initial construction stage the filter thus determined may in the form of a movable structure in front of the inlet window of the photoelectric detector, the filter being mounted on a support integral with the vacuum chamber.

In a second stage, it is also possible to apply the layers which constitute the filter directly onto the inlet window of the photoelectric detector outside of and/or inside of the vacuum chamber. In this second mode several design variations are possible.

According to a preferred initial version, the long wavelengths of the spectrum are eliminated by placing the low-pass filter on the external surface of the substrate.

According to a second design version the two extremities of the spectrum are eliminated by placing the low-pass filter on the external surface of the substrate and the high-pass filter on the internal surface of the substrate between the substrate and the photocathode.

According to a third design version, the two extremities of the spectrum are eliminated by placing the low-pass filter on the external surface of the substrate.

In cases where the filter is not situated on the same surface of the substrate as the photocathode, the filter is adapted specifically to this photocathode. In cases where the filter is arranged between the substrate and the photocathode, it is necessary to conduct a preliminary sensitivity measurement on a control photocathode positioned directly on a substrate of the same composition, to determine the extent of the spectrum where corrections have to be made. In this case, in order to design a filter to be located inside the chamber, the use of ZnS and $NaAlF_2$ must be avoided.

The substrate which bears the photocathode is usually made of glass. The variations in composition of the photocathode which are due to the chemical reactions of the alkalis with the glass may be reduced by replacing this vitreous substrate by a monocrystalline substrate such as quartz or corundum. As the substrate then has a better surface condition, this permits an improved nucleation of the layers which constitute the photocathode, with the filters thus improving their respective properties. This reduction of the variations in photoelectric power with the monocrystalline nature of the substrate is particularly sensitive in the blue part of the spectrum. Another version of the invention which corrects the red and blue parts of the spectrum entails using a low-pass filter—for the correction of the red part of the spectrum—positioned on the external surface of the monocrystalline substrate.

(1) the variations in photoelectric power of a photocathode of the type ($Na_2K$ Sb, Cs), (2) the transmission of a low-pass interference filter, (3) the variations in photoelectric power of the same photocathode equipped with a low-pass interference filter according to the invention.

DETAILED DESCRIPTION OF THE PREFERRED EMBODIMENTS

Figure 1:
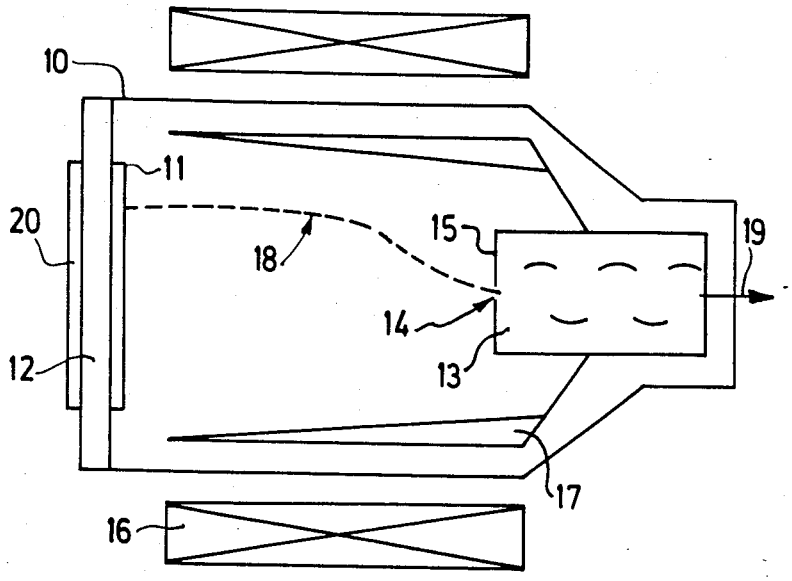
FIG. 1: a schematic representation of an image dissector tube.

FIG. 1 represents an image dissector tube comprising a vacuum chamber 10, having an inlet window formed by a substrate 12 on which is deposited a photocathode 11. Inside the vacuum chamber and opposite the inlet window of the tube an electron multiplier 13 is arranged, in front of which is positioned a plate 15 with a small aperture 14. Electrodes 17 are also arranged inside the chamber placed at potentials which are sufficient to accelerate and focus the electrons emitted by the photocathode 11. Deflection coils 16 deflect the electron beam and provide the scanning, so that the electrons emitted by each point of the photocathode are focused on the aperture 14 according to a trajectory 18. This electron beam is then captured by the multiplier 13 which supplies an electrical signal via an outlet 19, which is picked up either by a monitor tube or by an electronic signal processing device. An interference filter 20 is positioned in front of the substrate 12.

An optical device not shown on the diagram projects the scene to be analysed onto the inlet window of the dissector tube.

Figure 2:
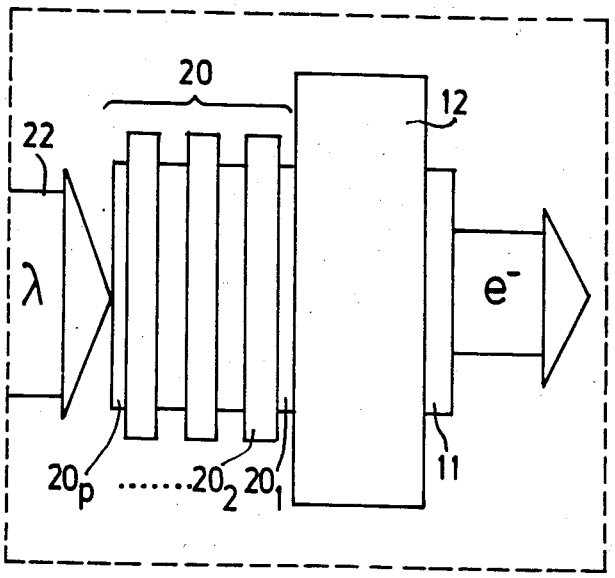
FIG. 2: a schematic of a window structure.

FIG. 2 shows the dissector tube inlet window in more detail in a non-limitative example. The photocathode 11 is deposited on the surface of the substrate 12, which is situated on the inside of the vacuum chamber. An interference filter 20, comprising a series of layers $\mathbf{20}_1$, $\mathbf{20}_2$, . . . , $\mathbf{20}_p$, which according to this diagram are constituted by layers of low index material $\mathbf{20}_1$, $\mathbf{20}_3$, . . . , $\mathbf{20}_p$ alternated with layers of high index material $\mathbf{20}_2$, $\mathbf{20}_4$, . . . , $\mathbf{20}_{p-1}$, is applied to the surface of the substrate 12, which is situated on the outside of the vacuum chamber. This series of layers is representative of the filters of the type A previously described. The scene to be analysed is projected onto the dissector tube in the form of an incident light beam 22 in wavelengths extending over a wide spectrum. It passes through the interference filter 20 producing at the outlet a light beam, of which the wavelengths are limited in the upper part and possibly in the lower part according to the given characteristics of the filter(s) in the context of the invention previously described. This beam of filtered wavelengths passes through the substrate 12, is then absorbed in the photocathode 11 to generate electrons emitted over the complete surface of the photocathode.

With the aid of the focusing and acceleration electrodes 17 and the deflection coils 16 shown in FIG. 1, the electrons emitted by each image point of the photocathode are directed onto the small aperture 14 situated at the entrance to the electron multiplier 13. The electrical signal obtained is then processed by a processing means with characteristics which permit the detection of two image points just a few microns apart on the photocathode.

Figure 3:
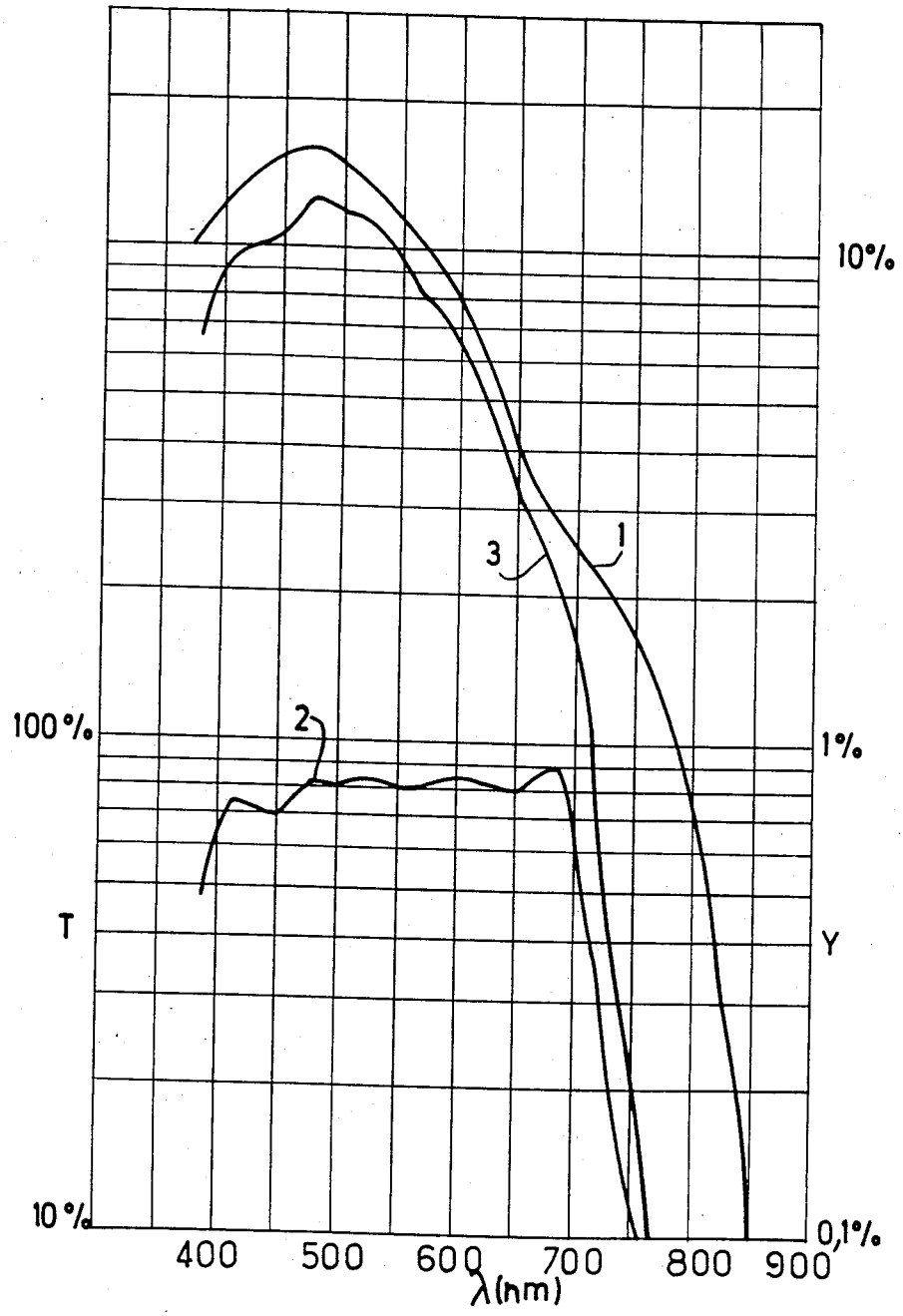
FIG. 3: three curves indicating, in relation to the wavelength.

FIG. 3 shows three curves:

Curve 1 represents the photoelectric power of a photocathode of the composition ($Na_2K$ Sb, Cs) with a thickness of 68 nm, for a wavelength varying between 400 nm and 850 nm, applied to the inlet window of a dissector tube. Between 850 nm and 760 nm a rapid increase in the photoelectric power is perceived. In this example, it is this part of the spectrum of incident light which the invention eliminates by inserting a filter. A reduction in the photoelectric power of the photocathode can also be percieved for the weaker wavelengths, particularly between 450 nm and 400 nm. This part of the wavelength spectrum may also be suppressed by filtering. The photoelectric power $Y_T$ is in this example equal to 10% of its maximum value towards $\lambda_f=760$ nm. The filter to be inserted is then determined so as to ensure that there is a transmission of approximately 10% for this wavelength, the effect of which will be to reduce the photoelectric power for this wavelength to approximately 1% of the maximum value. In the useful part of the spectrum the photoelectric power must be impaired as little as possible, that is to say that the filter must provide optimum transmission.

Curve 2 represents the transmission characteristics of an interference filter suitable for this function, formed by seven alternate layers of ZnS and $MgF_2$ ensuring the elimination of the upper part of the spectrum.

Curve 3 indicates the photoelectric power of the photocathode of the curve 1 applied to a glass substrate provided with a filter having the characteristics of curve 2, indicating that the upper part of the incident spectrum has been rendered inoperative.

The invention clearly relates to image reproduction tubes for which variations in photoelectric power at very short distances produce detrimental effects, which are to be eliminated.

What is claimed is:

1. Photoelectric detection device comprising a vacuum chamber with a window formed by a substrate having an external surface outside the vacuum chamber and an internal surface inside the vacuum chamber, said substrate bearing a photocathode inside the vacuum chamber, the device being sensitive to incident light radiation between a short wavelength lower threshold $\lambda_1$ and a longer wavelength upper threshold $\lambda_2$, said thresholds defining the initial sensitivity range, the electrons emitted by the photocathode being focused, accelerated and deflected by electronic means to deliver signals or an image representative of luminous events projected onto the photocathode, characterized in that the window is provided with light filter means which eliminates wavelengths greater than a wavelength $\lambda_f$ in the initial sensitivity range, such that $\lambda_1<\lambda_f<\lambda_2$, where $\lambda_f$ is determined when the initial sensitivity of the detection device is a given percentage of its maximum initial sensitivity.

2. Photoelectric detection device according to claim 1, wherein said filter means comprises a pass-band filter which also eliminates wavelengths lower than a wavelength $\lambda'_f$ in the initial sensitivity range, such that $\lambda_1<\lambda'_f<\lambda_f$, where $\lambda'_f$ is determined where the initial sensitivity of the detection device is a given percentage of its maximum initial sensitivity.

3. Photoelectric detection device as in claim 1, wherein the wavelength $\lambda_f$ is the wavelength for which the initial sensitivity of the detection device is approximately 10% of its maximum initial sensitivity.

4. Photoelectric detection device as in claim 2, wherein the wavelength $\lambda'_f$ is equal to 440 nm.

5. Photoelectric detection device as in claim 1, wherein said light filter means is arranged in front of the window on the outside of the vacuum chamber.

6. Photoelectric detection device as in claim 1, wherein said light filter means is positioned on the external surface of the substrate.

7. Photoelectric detection device as in claim 1, wherein said light filter means is positioned on the internal surface of the substrate.

8. Photoelectric detection device as in claim 1, wherein said light filter means is a pass-band filter constituted by a high-pass light filter on the internal surface and a low-pass light filter on the external surface of the substrate.

9. Photoelectric detection device as in claim 1, wherein said light filter means is an interference filter constituted by a series of thin layers.

10. Photoelectric detection device as in claim 1, wherein the substrate is a monocrystalline substrate.

11. Photoelectric detection device according to claim 10, characterized in that the substrate is a quartz plate.

12. Photoelectric detection device according to claim 10, characterized in that the substrate is a corundum plate.

13. Photoelectric detection device as in claim 1 wherein said light filter means transmits approximately 10% of incident light of wavelength $\lambda_f$.

14. Photoelectric device as in claim 1 wherein said light filter means transmits approximately 10% of incident light of wavelength $\lambda_f$.

15. Photoelectric device as in claim 2 wherein said light filter means transmits approximately 10% of incident light of respective wavelengths $\lambda'_f$ and $\lambda_f$.

16. Photoelectric detection means as in claim 1, wherein said device is an image dissector tube.

17. An image dissector tube comprising a vacuum chamber with a window formed by a substrate having an external surface outside the vacuum chamber and an internal surface directly on its internal surface, said substrate bearing a photocathode inside the vacuum chamber, the device being sensitive to incident light radiation between a short wavelength lower threshold $\lambda_1$ and a longer wavelength upper threshold $\lambda_2$, said thresholds defining the initial sensitivity range, the electrons emitted by the photocathode being focused, accelerated and deflected by electronic means to deliver signals or an image 18. Photoelectric detection device as in claim 17 wherein said monocrystalline substrate is chosen from the group consisting of quartz and corundum representative of luminous events projected onto the photocathode, characterized in that the substrate is a monocrystalline substrate, which substrate reduces variations in photoelectric power for incident light in the blue part of the spectrum.

19. Photoelectric detection device as in claim 17, wherein the window is provided with light filter means which eliminates wavelengths greater than a wavelength $\lambda_f$ in the initial sensitivity range, such that $\lambda_1<\lambda_f<\lambda_2$, where $\lambda_f$ is determined where initial sensitivity of the detection device is a given percentage of its maximum initial sensitivity.

20. Photoelectric detection device as in claim 19 wherein sid filter means is a filter positioned on the external surface of the monocrystalline substrate.

* * * * *

UNITED STATES PATENT AND TRADEMARK OFFICE

CERTIFICATE OF CORRECTION

PATENT NO. : 4,698,496

DATED : October 6, 1987

INVENTOR(S) : Pierre Dolizy

It is certified that error appears in the above-identified patent and that said Letters Patent is hereby corrected as shown below:

IN THE CLAIMS

| | | |
|---|---|---|
| Claim 14, | line 3 | change " $\lambda_f$" to --$\lambda'_f$-- |
| Claim 17, | line 4 | delete "directly on its internal surface" insert --inside the vacuum chamber-- |
| | line 6 | after "chamber," insert --directly on its internal surface,-- |
| | line 12 | after "image" insert --representative of luminous events projected onto the photocathode, characterized in that the substrate is a monocrystaline substrate, which substrate reduces variations in |

UNITED STATES PATENT AND TRADEMARK OFFICE

CERTIFICATE OF CORRECTION

PATENT NO. : 4,698,496

DATED : October 6, 1987

INVENTOR(S) : Pierre Dolizy

It is certified that error appears in the above-identified patent and that said Letters Patent is hereby corrected as shown below:

IN THE CLAIMS

Claim 17, line 12 continued photoelectric power for incident light in the blue part of the spectrum.--

Claim 18, line 3 after "corundum" delete sentence in its entirety, starting with"representative" and ending with "spectrum."

Signed and Sealed this

Twenty-fourth Day of January, 1989

*Attest:*

*Attesting Officer*

DONALD J. QUIGG

*Commissioner of Patents and Trademarks*